United States Patent [19]

Blake

[11] Patent Number: 4,974,432

[45] Date of Patent: Dec. 4, 1990

[54] COMBINATION LOCK FOR USE ON A ZIPPER

[76] Inventor: Chien-Yung H. Blake, No. 40, Chao An Street, Taipei, Taiwan, Taiwan

[21] Appl. No.: 393,277

[22] Filed: Aug. 14, 1989

[51] Int. Cl.[5] ..... E05B 65/68

[52] U.S. Cl. ..... 70/68; 70/312

[58] Field of Search ..... 70/59, 64–68, 70/69–71, 312; 24/386, 387, 425, 426

[56] References Cited

U.S. PATENT DOCUMENTS

| | | | |
|---|---|---|---|
| 3,973,419 | 8/1976 | Atkinson | 70/68 |
| 4,244,086 | 1/1981 | Gregg | 70/68 X |
| 4,262,502 | 4/1981 | Oda | 70/68 |
| 4,366,685 | 1/1983 | Bako et al. | 70/68 |
| 4,691,540 | 9/1987 | Murase | 70/68 |
| 4,756,173 | 7/1988 | Yang | 70/68 |
| 4,790,156 | 12/1988 | Yang | 70/68 |
| 4,817,769 | 4/1989 | Saliba | 70/68 X |
| 4,884,419 | 12/1989 | Ling | 70/68 X |

*Primary Examiner*—Gary L. Smith

*Assistant Examiner*—Suzanne L. Dino

*Attorney, Agent, or Firm*—Finnegan, Henderson, Farabow, Garrett & Dunner

[57] ABSTRACT

A combination lock for use on a zipper comprises a first shell and a second shell fastened together to form a lock housing. A ring is disposed on the second shell for connecting the lock to the zipper. A pushing block is slidably disposed on the second shell and has a pressed position and a released position. A spring biases the pushing block outwardly to keep it in the releasing position. A two gear assembly is rotatably disposed on the second shell and each has a breach on its edge, and a numbering wheel assembly is rotatably disposed between the first shell and each gear assembly for controlling the rotation of the gear assembly. Protrusions are disposed on the pushing block for engaging with each breach when the pushing means is in the pressed position. A hook is disposed on the pushing block for locking the lock to a ring affixed to a piece of luggage when the ring is inserted into an opening in the second shell.

5 Claims, 5 Drawing Sheets

COMBINATION LOCK FOR USE ON A ZIPPER

BACKGROUND OF THE INVENTION

1. Field of the Invention

This invention relates to a combination lock for use on a zipper, particularly, to a combination lock having an iron ring and an opening disposed on the housing thereof for connecting with the pull tab and bottom stop of the zipper respectively.

2. Description of the Prior Art

Conventionally, a zipper generally comprises a slide and a pull tab. The slide can be slided on a set of closed teeth between the top stop and the bottom stop. With the movement of the slide between the top stop and the bottom stop, the closed teeth could be opened or closed. The position of the closed teeth is controlled by pulling the pull tab.

The aforementioned known zipper could be disposed on a luggage. However, the known zipper will be opened during transporting. This phenomena causes the articles contained in the luggage to be dropped off. In order to overcome this disadvantages, a ring of a small lock is connected with the pull tab and a ring provided on the top stop, therefore, locking the luggage free from opening. As the user wish to open the luggage, the lock should be released from the zipper firstly. Then pulling the pull tab slides from the top stop to the end stop. Since the known lock should be released from the zipper, the location for containing the known lock releasing from the luggage cannot be easily remembered.

SUMMARY OF THE INVENTION

It is an object of this invention to provide a combination lock for use on a zipper, it could be used as a pulling portion of a zipper and could prevent the zipper from opening.

The further object of this invention is to provide a combination lock for use on a zipper having an opening disposed on the housing thereof to be easily connected with the top end of the zipper.

The present combination lock for use on a zipper comprises a first shell having a hole disposed thereon; a second shell having an opening; a connecting means for engaging the first shell and the second shell together; a ring disposed on the second shell for connecting with the zipper; a pushing means slidably disposed on the second shell and having a pressed position and a releasing position; a flexible means for biasing the pushing means to keep in the releasing position; a gear assembly rotatably disposed on the second shell and having a breach on its edge; a numbering wheel assembly rotatably disposed between the first shell and the gear assembly for controlling the rotation of the gear assembly; a protrusion disposed on the pushing means for engaging with the breach to provide the pushing means in the pressed position; and a hook means disposed on the pushing means for holding the zipper.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

DESCRIPTION OF THE PREFERRED EMBODIMENTS

Figure 1:
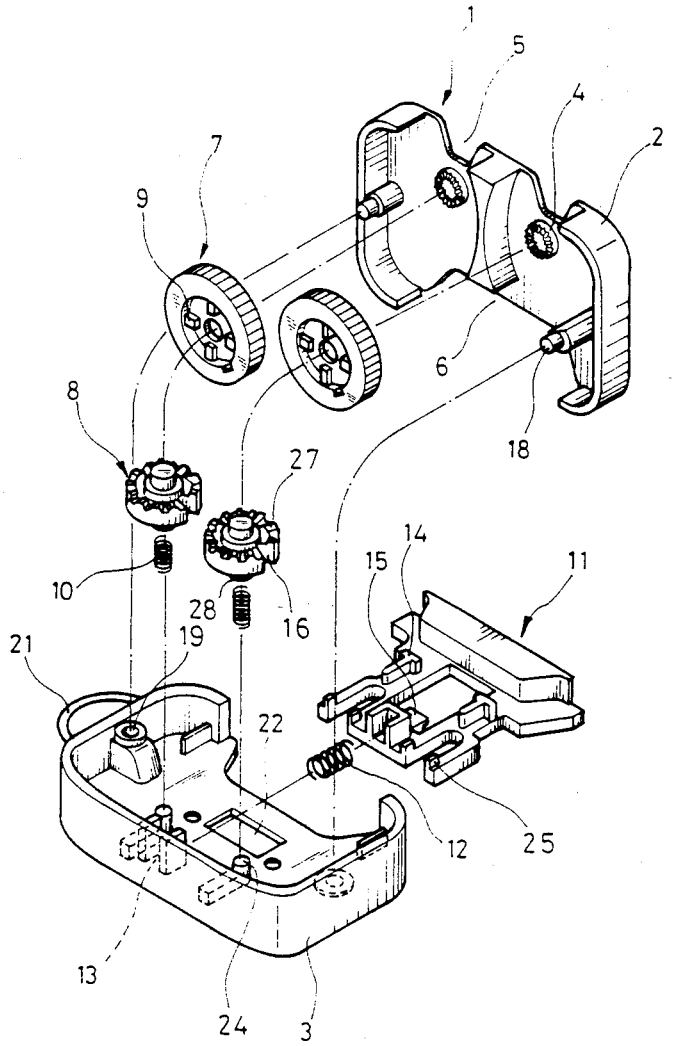
FIG. 1 is an exploded view showing a preferred embodiment of the present invention.
Figure 2:
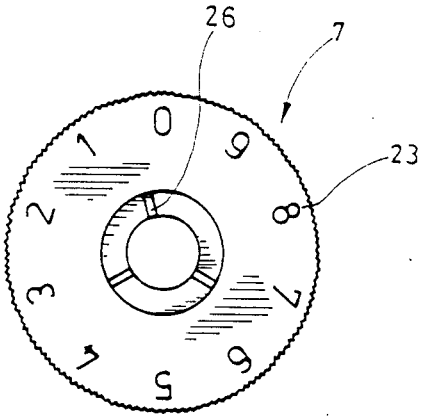
FIG. 2 is a top view showing the numbering wheel of the present invention.

Referring to Figures, the present combination lock 1 comprises a first shell 2 and a second shell 3. Two indented surface 4 are respectively disposed on the bottom portion of the first shell 2. One edge portion of the first shell 2 are provided with two holes 5 and the opposite edge thereof also disposed a recess 6. Two numbering wheels 7 which includes teeth 9 disposed on the inner side thereof for engaging with teeth 27 of gear 8 ae respectively located between and engaged with the indented surface 4 and gear 8. The combination of the numbering wheel 7 and the gear 8 are biased against the indented surface 4 by a small protrusion 25 and a spring 10 which is located on a protrusion 24. Therefore, the small protrusion 25 support a flange 28 of the gear 8 to provide a perfect contact between the numbering wheel 7 and the indented surface 4. The upper surface of the numbering wheel 7 is provided with three engaged teeth 26 to engage with the indented surface 4 for controlling the rotation of the numbering wheel 7. A pushing block 11 are movably and slidably disposed between the first 2 and second 3 shells to release or lock the present combination lock 1. The pressed and depressed position of the pushing block 11 are controlled by the second spring 12 disposed on a groove 13. Two protrusions 14 are disposed on the pushing block 11 and could be engaged with a breach 16 of the gear 8 to move the hook 15. As the hook 15 forwardly moving, it will be released from a ring 17 which is protruded to the inside portion of the second shell 2 through an opening 22. Two pivots 18 are respectively provided on the base surface of the first shell 2 for connecting with two holes 19 of the second shell 3. Therefore, the present combination lock 1 could be fixed to the slide 20 through a ring 21.

Figure 3:
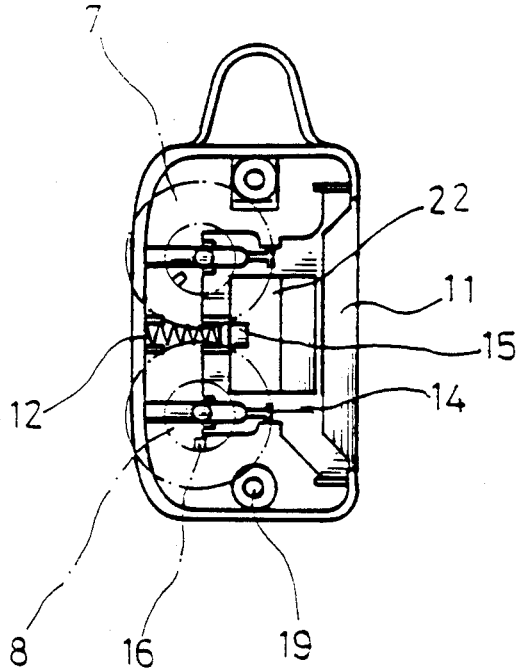
FIGS. 3 and 4 is a sectional top view showing a preferred embodiment of this invention.
Figure 4:
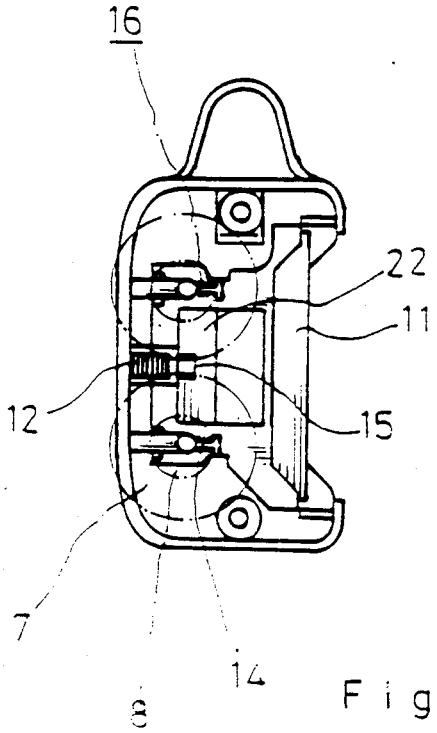
Figure 5:
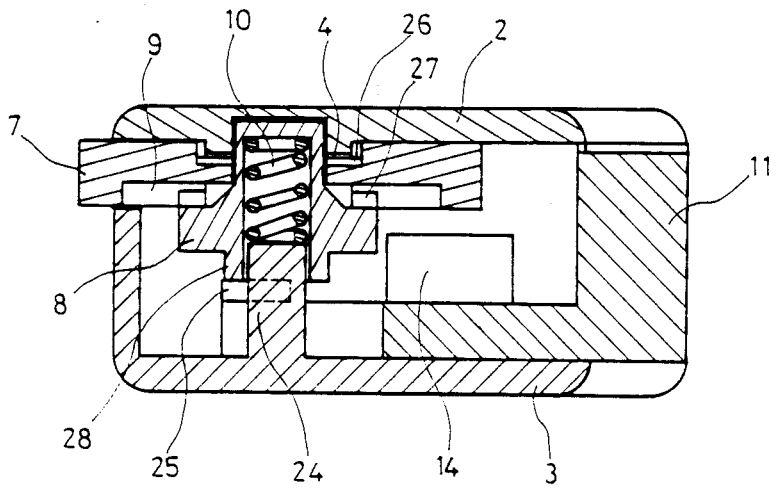
FIGS. 5 and 6 is a sectional side view showing a preferred embodiment of this invention.
Figure 6:
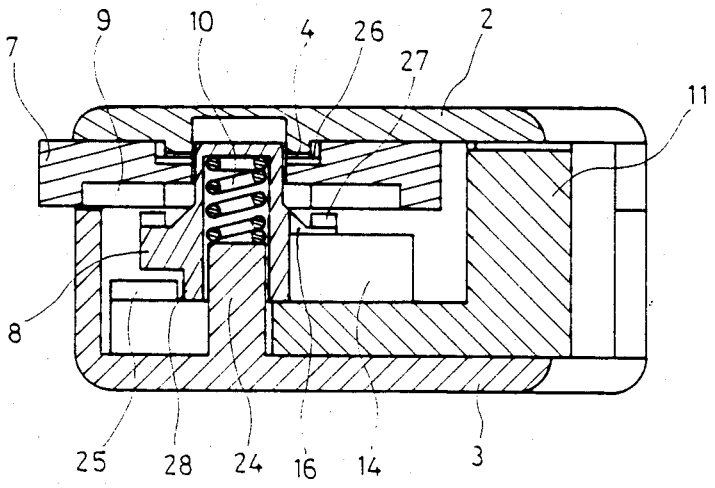
Figure 7:
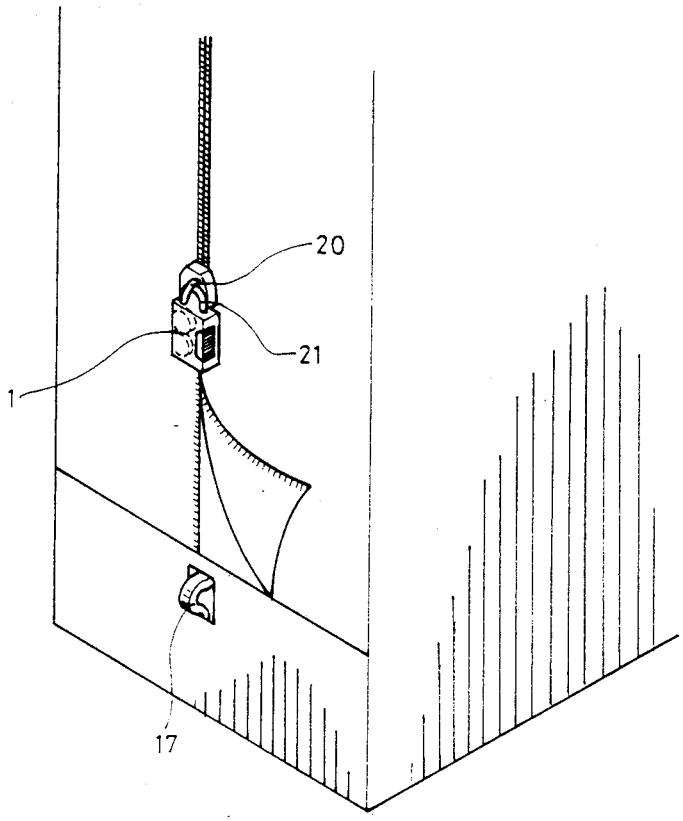
FIG. 7 is a perspective view showing the combination of a preferred embodiment of this invention with a zipper.

In use, the ring 21 of the combination lock 1 is connected to the slide 20 of the zipper to be used as a pull tab. When the combination lock 1 is pulled to the ring 17, the number 23 exposed through the holes 5 will be in a predetermined number through the rotation of the numberingwheel 7 and the breach 16 will be aligned with the protrusion 14. The engagement between the breach 16 and the protrusion 14, as shown in FIG. 4, is achieved by pressing the pushing block 10. Then, the ring 17 passed through the opening 22 and entered the combination lock 1. Releasing the force applied on the pushing block 1, the forwardly biasing force generated by spring 12 makes the hook 15 passing through the space of the ring 17 and locks the combination lock 1 with the ring 17 together. The numbering wheel 7 will be rotated again to the other number wherein the pushing block 11 cannot be press down, as shown on FIG. 3.

Therefore, the actually and easily locking purpose can be achieved.

If the user wish to change the predetermined number of the present combination lock 1, the numbering wheel 7 should be rotated to the previously predetermined number and pressed down to engage the protrusion 14 with the breach 16. The flange 28 of the gear 8 is free from the blockage of the small protrusion 25 and only engage with the numbering wheel 7 by the force of the spring 10. Keeping the pushing block 11 in the pressing position and simutaneously rotating the numbering wheel 7, the pressing force is released after the desired number being achieved. The gear 8 will be re-blocked by the small protrusion 25 again and now there is no space for teeth 7 to be un-engaged with the numbering wheel 7. From now on, the combination lock 1 can be opened only at new combination.

While specific embodiments have been illustrated and described, numerous modifications come to mind without significantly departing from the spirit of the invention and the scope of protection is only limited by the scope of the accompanying claims.

What is claimed is:

1. A combination lock for use on a zipper, which comprises:

(a) first and second shells;

(b) connecting means for holding said shells together to form a lock housing;

(c) a ring member secured to said housing for connecting said lock to a zipper;

(d) the first of said shells having a first edge portion and an opposing second edge portion, said first edge portion being provided with at least one depression thereon and said opposing edge portion being provided with a recess thereon;

(e) the second of said shells having an edge portion provided with a recess positioned thereon opposite said recess in said opposing second edge portion;

(f) a pushing block member slidably disposed on said second shell and having an outer portion extending between said opposing recesses and an inner portion extending into said housing between said shells, said pushing member being slidable in said housing between a pressed position and a released position;

(g) spring means for biasing said pushing member outwardly toward said released position;

(h) a hook member on said inner portion of said pushing member for engaging a locking ring for holding said zipper when said pushing member is in the released position;

(i) at least one gear assembly rotatably disposed on the interior of said second shell and comprising a circular flange with a radially-extending breach in its periphery and a plurality of teeth extending from said flange toward said first shell;

(j) at least one rotatable circular numbering wheel disposed between said flange and said first shell, said numbering wheel being provided with teeth on one side thereof for engaging with the teeth on said flange for controlling the rotation of said gear assembly; and (k) at least one protrusion on the inner portion of said pushing member for engaging with said breach when said pushing member is in the pressed position;

said hook member being disengagable from said locking ring when said pushing member is in the pressed position.

2. A combination lock for use on a zipper as claimed in claim 1, further comprising an indented surface disposed on the inner surface of said first shell against which said numbering wheel is biased.

3. A combination lock for use on a zipper as claimed in claim 2, further comprising a spring disposed between said gear assembly and said second shell for biasing said gear assembly and said numbering wheel to contact each other and for biasing said numbering wheel against said indented surface.

4. A combination lock for use on a zipper as claimed in claim 1, wherein said second shell is provided with an opening for receiving said locking ring and said hook member extends across said opening to engage said locking ring when said pushing member is in the released position.

5. A combination for use on a zipper as claimed in claim 3, wherein said numbering wheel is provided on the side thereof adjacent said first shell with teeth for engaging said indented surface and controlling the rotation of said numbering wheel.

* * * * *